United States Patent [19]

Dahlberg et al.

[11] 4,389,301

[45] Jun. 21, 1983

[54] TWO-STEP HYDROPROCESSING OF HEAVY HYDROCARBONACEOUS OILS

[75] Inventors: Arthur J. Dahlberg, Rodeo; John H. Shinn, Richmond; Joel W. Rosenthal, El Cerrito; Tim T. Chu, Oakland, all of Calif.

[73] Assignee: Chevron Research Company, San Francisco, Calif.

[21] Appl. No.: 314,141

[22] Filed: Oct. 22, 1981

[51] Int. Cl.[3] ..... C10G 47/06; C10G 49/12

[52] U.S. Cl. ..... 208/59; 208/108; 208/111; 208/149; 208/157

[58] Field of Search ..... 208/59, 108, 89, 111, 208/149

[56] References Cited

U.S. PATENT DOCUMENTS

| | | | |
|---|---|---|---|
| 2,462,891 | 3/1949 | Noll | 208/149 |
| 2,956,004 | 10/1960 | Conn et al. | 208/91 |
| 3,074,879 | 1/1963 | Weekman | 208/111 |
| 3,331,769 | 7/1967 | Gatsis | 208/210 |
| 3,583,900 | 6/1971 | Gatsis | 208/8 |
| 3,635,943 | 1/1972 | Stewart | 208/157 |
| 3,707,461 | 12/1972 | Gatsis | 208/111 |
| 3,817,855 | 6/1974 | Smith et al. | 208/89 |
| 4,018,663 | 4/1977 | Karr, Jr. | 208/10 |
| 4,066,530 | 1/1978 | Aldridge et al. | 208/112 |
| 4,169,041 | 9/1979 | Schuette | 208/108 |
| 4,172,814 | 10/1979 | Moll | 208/108 |
| 4,285,804 | 8/1981 | Jacquin et al. | 208/48 R |

FOREIGN PATENT DOCUMENTS

| | | | |
|---|---|---|---|
| 1073389 | 3/1980 | Canada | 196/146 |
| 1076983 | 5/1980 | Canada | 196/130 |

*Primary Examiner*—Delbert E. Gantz
*Assistant Examiner*—G. E. Schmitkons
*Attorney, Agent, or Firm*—D. A. Newell; S. R. La Paglia; S. H. Roth

[57] ABSTRACT

A heavy hydrocarbonaceous oil feed is hydrogenated in a two-stage process by contacting the oil with hydrogen in the presence of added dispersed hydrogenation catalyst, suspended in the oil, and porous solid contact particles. At least part of the normally liquid product from the first stage is hydrogenated in a second stage catalytic hydrogenation reactor.

16 Claims, 1 Drawing Figure

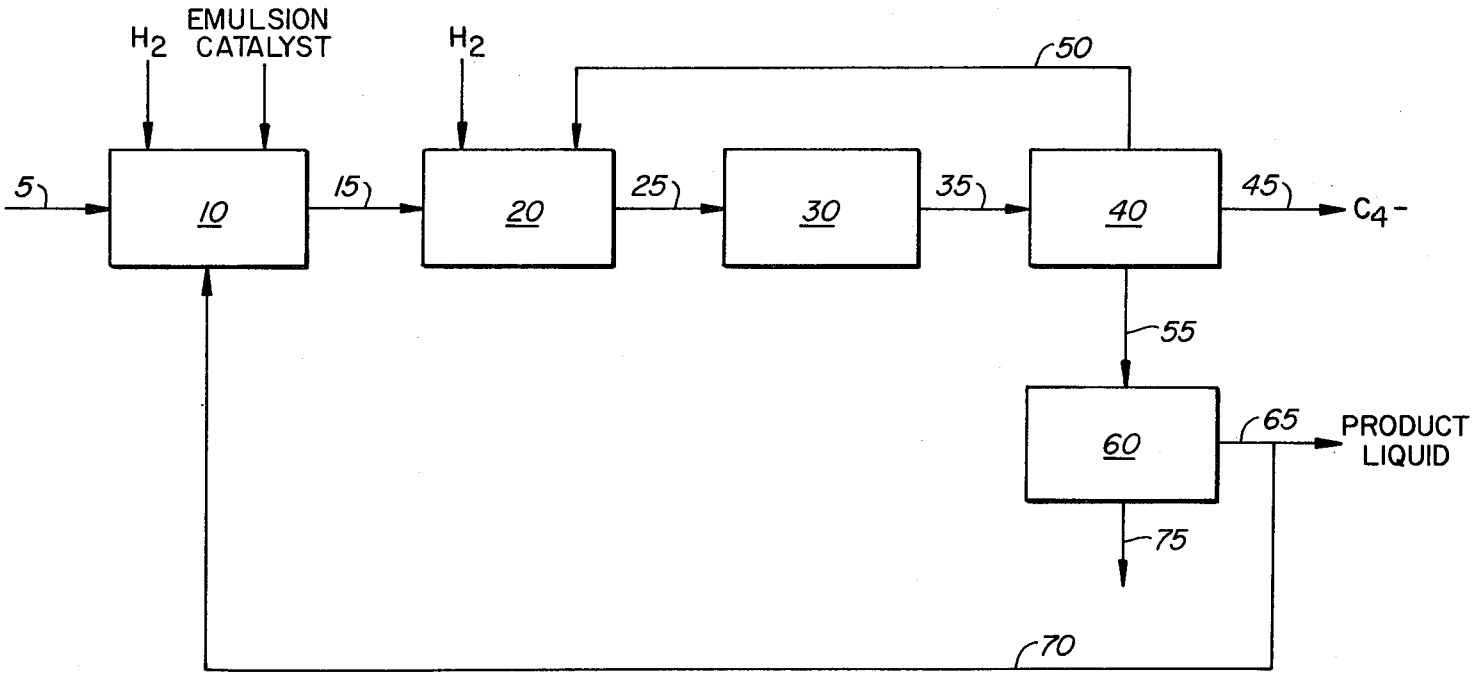
5
$H_2$
EMULSION CATALYST
10
15
$H_2$
20
25
30
35
40
50
45
$C_4$ -
55
60
65
PRODUCT LIQUID
70
75

TWO-STEP HYDROPROCESSING OF HEAVY HYDROCARBONACEOUS OILS

BACKGROUND OF THE INVENTION

This invention relates to the hydroprocessing of heavy oils and more particularly to the hydroprocessing of heavy oils in the presence of particulate solids. According to this invention, heavy hydrocarbonaceous oils are hydroprocessed to achieve a normally liquid product having one or more of (a) a reduced average molecular weight, (b) a reduced sulfur content, (c) a reduced nitrogen content, and (d) a reduced content of soluble metals contaminants (Ni, V, and Fe).

A variety of heavy oil processing techniques which involve the addition of solids have been reported. U.S. Pat. No. 2,462,891 discloses the treatment of an oil with inert fluidized heat transfer solids followed by solids separation and further treatment in the presence of a fluidized catalyst. U.S. Pat. No. 3,331,769 discloses the addition of soluble decomposable organometallic compounds to a feedstock prior to contacting with a supported particulate catalyst. U.S. Pat. No. 3,635,943 discloses hydrotreating oils in the presence of both a fine catalyst and a coarse catalyst. Canadian Pat. Nos. 1,073,389 and 1,076,983 disclose the use of particles such as coal for treatment of heavy oils. U.S. Pat. No. 3,583,900 discloses a coal liquefaction process which can employ dispersed catalysts and downstream catalytic refining. U.S. Pat. No. 4,018,663 discloses two-stage coal liquefaction involving noncatalytic contact particles in a dissolution stage. U.S. Pat. No. 3,707,461 describes the use of coal derived ash as a hydrocracking catalyst. U.S. Pat. No. 4,169,041 discloses a coking process employing a finely divided catalyst and the recycle of coke. U.S. Pat. No. 4,066,530 discloses the addition of a solid iron-containing species and a catalyst precursor to a heavy oil and U.S. Pat. No. 4,172,814 discloses the use of an emulsion catalyst for conversion of ash-containing coals. Heretofore, however, it has not been recognized that finely divided catalysts interact synergistically with porous contact particles in the hydrogenation of heavy oils.

SUMMARY OF THE INVENTION

This invention is a two-stage process for hydroprocessing a heavy hydrocarbonaceous oil feed to convert at least a portion of components boiling above 350° C. to components boiling below 350° C. comprising (a) contacting said oil feed with added hydrogen in a reaction zone under hydroprocessing conditions in the presence of (1) solids suspended in said oil and containing at least one added catalytic hydrogenation component selected from transition elements or components thereof, and (2) added porous contact particles to produce a first effluent having a normally liquid portion; and (b) contacting at least a portion of the normally liquid portion of said first effluent in a second reaction zone with hydrogen under hydrogenation conditions in the presence of a bed of particulate hydrogenation catalyst to produce a second effluent. The process is particularly advantageous for processing carbonaceous feedstocks containing soluble metal contaminants, e.g., Ni, V, Fe. When the heavy hydrocarbonaceous oil feed contains soluble metals contaminants, the hydroprocessing causes a deposition of metals from the soluble metal contaminants onto the second added particulate solids, thereby producing an effluent having a normally (room temperature at one atmosphere) liquid portion with a reduced soluble metals concentration. The dispersed catalyst can be added as a water/oil emulsion prepared by dispersing a water soluble salt of one or more transition elements in oil before or concurrently with introduction of the catalyst to the oil feed. The porous contact particles are preferably inexpensive materials such as alumina, porous silica gel, naturally occurring or treated clays, etc.

BRIEF DESCRIPTION OF THE DRAWINGS

The single FIGURE of drawing is a block diagram showing a two-stage heavy oil treatment process according to this invention.

DETAILED DESCRIPTION OF THE INVENTION

According to this invention, a heavy oil is hydroprocessed in the presence of two distinct types of added particulate solids: (1) a finely divided suspended catalyst and (2) porous contact particles which may or may not be suspended. For purposes of this invention, the term "added particulate solids" is intended to include only materials which are not normally present in the feed, e.g., as impurities or by-products of previous processing. Likewise, the term "added particulate solids" does not include solids which are normally indigenous to the hydrocarbonaceous feed itself, such as unreacted coal in coal-derived oils or oil shale fines in retorted shale oil, etc. The porous (i.e., non-glassy) contact particles are preferably totally or substantially free of catalytic transition metals or transition metal compounds added to impart catalytic activity to the solids; however, the contact particles can contain added catalytic metal components when economically justified. The porous contact particles are preferably inexpensive materials such as alumina, porous silica gel, clays and waste catalyst fines, which only incidentally contain catalytic metals as a result of their prior service. The porous contact particles may include ash from coal liquefaction, which may or may not contain carbonaceous coal residue. Coal ash high in average iron content could function as a dispersed catalyst in combination with a separate non-catalytic contact particle. Coal ash low in average iron content could function as non-catalytic contact particles in combination with a separate dispersed hydrogenation catalyst.

According to this invention, it has been found that dispersed hydrogenation catalysts interact synergistically with porous contact particles during hydroprocessing of heavy hydrocarbonaceous feedstocks. Suitable heavy oil feedstocks according to this invention include crude petroleum, petroleum residua, such as atmospheric and vacuum residua, vacuum gas oils, reduced crudes, deasphalted residua, and heavy hydrocarbonaceous oils derived from coal, including anthracite, bituminous, sub-bituminous coals and lignite, hydrocarbonaceous liquids derived from oil shale, tar sands, gilsonite, etc. Typically the hydrocarbonaceous liquids will contain more than 50 weight percent components boiling above 200° C.

The process of this invention is particularly effective for hydroprocessing heavy oil feeds which contain soluble metals compounds, at least 5 ppm total Ni+V, or even 50+ppm, which are typically present in crude petroleum, petroleum residua and shale oil or shale oil fractions, and which also typically contain at least about 2, or in some cases at least about 0.1 weight percent n-heptane insoluble asphaltenes.

First-stage hydroprocessing conditions suitable for use according to this invention include a hydrogen partial pressure above 35 atmospheres, a temperature in the range of 400° to 480° C., preferably 425° to 455° C., the residence time of 0.01 or 0.1 to 3 hours, preferably 0.1 to 1 hour, pressure in the range of 40–680 atmospheres, preferably 100 to 340 atmospheres, and a hydrogen gas rate of 355 to 3550 liters per liter of oil feed, and preferably 380 to 1780 liters per liter of oil feed. Preferably, the first-stage hydroprocessing zone is operated in the absence of externally provided carbon monoxide. However, small amounts of carbon monoxide may be present in internally recycled gas to the hydroprocessing zone. If desired, the first-stage hydroprocessing zone may be sufficiently elongated to attain plug flow conditions. Preferably the feed will flow upwardly through the hydroprocessing zone. A suitable feed distribution system is described in commonly assigned U.S. patent application Ser. No. 160,793, filed June 19, 1980 and entitled "Gas Pocket Distributor for an Upflow Reactor", which is incorporated herein by reference.

The finely divided catalytic material to be dispersed can be added either as a finely divided transition metal compound such as a transition metal sulfide, nitrate, acetate, etc. Examples of suitable transition metal compounds include $Ni(NO_3)_2.6H_2O$, $NiCO_3$, $(NH_4)_6Mo_7O_{24}.4H_2O$, $(NH_4)_2MoO_4$, $Co(NO_3)_2.6H_2O$, $CoCO_3$, and various oxides and sulfides of iron, cobalt, and nickel. The dispersed catalytic material may alternately be added as an aqueous solution of one or more water soluble transition metal compounds such as molybdates, tungstates or vanadates of ammonium or alkali metals. Suitable emulsion catalysts and a method for their introduction are described in U.S. Pat. No. 4,172,814, issued Oct. 30, 1979 Moll et al for "Emulsion Catalyst For Hydrogenation Catalyst", which is incorporated herein by reference. Alternately the dispersed hydrogenation catalyst can be added as an oil soluble compound, e.g., organometallic compounds such as molybdenum naphthenates, cobalt naphthenates, molybdenum oleates, and others as are known in the art. If finely divided iron compounds are employed, the feed can be contacted with $H_2S$ in sufficient quantity to convert the iron species to catalytic species.

The concentration of dispersed, suspended hydrogenation catalyst is preferably less than 20 weight percent of the feed calculated as catalytic metal and more preferably 0.001 to 5 weight percent of the feed to the first stage. When the finely divided catalyst is added as a emulsion, it is preferably mixed by rapid agitation with the feed prior to entry into the hydroprocessing zone wherein contact is made with the porous contact particles. In addition the finely divided hydrogenation catalyst can be added to the oil feed or to any recycle stream fed to the first-stage hydrogenation zone of the process. The added hydrogenation catalyst is preferably added in an amount sufficient to suppress coke formation within the first-stage hydroprocessing zone.

The porous contact particles are preferably inexpensive porous materials, such as alumina, silica gel, petroleum coke, and a variety of naturally occurring clays, ores, etc. A particularly convenient material for use as a contact material is spent fluid catalytic cracking fines, which are typically 10–50 microns in diameter, however, some submicron material may also be present. The spent FCC fines can contain zeolitic material and can also contain small amounts of contaminants from the prior feedstock, including iron, nickel, vanadium, sulfur, carbon and minor amounts of other components. For purposes of this invention spent fluid catalytic cracking fines have the composition and properties listed in Table 1.

TABLE 1

COMPOSITION AND CHARACTERISTICS OF SPENT FCC FINES

| | |
|---|---|
| Mean Particle Diameter, microns | 5–50 |
| Bulk Density, grams/cc | 0.25–0.75 |
| Surface Area, meter$^2$/gram | 50–200 |
| Pore Volume, cc/gram | 0.1–0.6 |
| Fe concentration, % by weight | 0.10–1 |
| C concentration, % by weight | 0.1–2 |
| Ni concentration, ppm | 50–2000 |
| V concentration, ppm | 50–2000 |

The porous contact particles can be suspended or entrained in the oil, e.g., in a concentration of 0.1–20 weight percent, or can be present as a packed or expanded bed. Because metals from soluble metals compounds in the feed tend to deposit upon the contact particles, it is preferred that the particles be in a restrained bed, rather than being entrained with the product. Preferably the bed is a packed bed, such as a fixed or a gravity-packed moving bed. One convenient technique is to employ the contact particles in a bed which moves only periodically in order to replace particles which become heavily loaded with contaminant metals with fresh material. The bed can move co-currently or countercurrently, preferably countercurrently.

In addition to the catalyst and contact particles, a hydrogen donor oil may be added to the hydrogenation zone to help prevent coke formation. This hydrogen donor oil can be a recycle stream from the hydrogenated product or it can be supplied from an external source, such as hydrogenated petroleum or coal liquids.

At least a portion of the effluent from the first stage is passed to a second-stage catalytic hydrogenation zone wherein it is contacted with hydrogen in the presence of a bed of conventionally supported hydrogenation catalyst. Preferably, substantially all of the dispersed catalyst is passed through the second stage. Substantially all of the contact particles can also be passed through the second stage, if desired, but preferably they are retained in the first reaction zone. Preferably, the entire effluent from the first reaction zone is substantially free of the contact particles and is passed to the second zone.

The second reaction zone preferably contains a packed or fixed bed of catalyst, and the entire liquid feed to the second reaction zone preferably passes upwardly through the bed of catalyst. A flow distributor as described in the above U.S. patent application Ser. No. 160,793 may be used, if desired. The packed bed can move periodically, if desired, to permit catalyst replacement. The catalyst in the second reaction zone can be present as an ebullating bed, if desired. The catalyst in the second reaction zone should be of a different composition than the finely divided catalyst or contact particles added to the first stage.

The preferred catalyst for the second stage comprises at least one hydrogenation component selected from Groups VI-B and VIII, present as metals, oxides, or sulfides. The hydrogenation component is supported on a refractory inorganic base, for example, alumina, silica, and composites of alumina-silica, alumina-boria, silica-alumina-magnesia, silica-alumina-titania. Phosphorus promoters can also be present in the catalyst. A suitable catalyst can contain, for example, 1 to 10% Co, 1 to 20% Mo, and 0.5 to 5% P on a γ-alumina support. Such a catalyst can be prepared according to the teachings of U.S. Pat. No. 4,113,661, to Tamm, the disclosure of which is incorporated herein by reference.

The second hydrogenation zone is operated at a temperature lower than the first hydrogenation zone, and generally 315° to 455° C., preferably 340° to 425° C., more preferably 360° to 400° C.; a pressure of generally 40 to 340 atmospheres, preferably 70 to 210 atmospheres, more preferably 140 to 190 atmospheres; a space velocity of generally 0.1 to 2, preferably 0.2 to 1.5, more preferably 0.25 to 1 hour$^{-1}$; a hydrogen feed rate of generally 170 to 3400 liters/liter of feed, preferably 340 to 2700 liters/liter, more preferably 550 to 1700 liters/liter.

PREFERRED EMBODIMENT

Referring to the drawing, a heavy hydrocarbonaceous oil feed, such as petroleum vacuum residuum is contacted in zone 10 with an emulsion prepared by dispersing aqueous ammonium heptamolybdate solution in fuel oil. The amount of molybdenum in the emulsion is sufficient to provide 0.00005 to 0.0005 kilograms of molybdenum, as metal per kilogram of residuum. The feed containing dispersed catalyst is passed through line 15 to the first-stage hydrogenation zone 20 wherein it is contacted with hydrogen at 400° to 450° C., a pressure of 170 to 200 atmospheres, a hydrogen pressure of 150 to 190 atmospheres, a hydrogen rate of 1500–1800 liters/liter of feed, and a residence time of 0.5 to 2 hours. Hydrogenation zone 20 is an upflow vessel containing a packed bed of attapulgite clay. The entire effluent from first hydrogenation zone 20 is passed to second hydrogenation zone 30 through a conduit 25. The second hydrogenation zone 30 is an upflow vessel containing a fixed bed of hydrogenation catalyst comprising Co, Mo, and P on a γ-alumina support. The second hydrogenation zone is preferably operated at a temperature of 360° to 400° C., a pressure of 170 to 200 atmospheres, a residence time of 1 to 5 hours, and a hydrogen pressure of 150 to 190 atmospheres. The effluent from second hydrogenation zone 30 is passed through conduit 35 to a high pressure separator 40 wherein recycle gas rich in hydrogen is removed and recycled through line 50, $C_4$-hydrocarbon product is received through line 45, and normally liquid product is passed to solids separator 60, e.g., a filter or hydroclone, normally liquid hydrocarbons are obtained through line 65 and solids, including catalyst particles, are withdrawn through line 75. If desired, a portion of the normally liquid product is recycled through line 70 to zone 10.

Comparative Examples

The following examples demonstrate the synergistic effects obtainable when a dispersed catalyst and additional solids are present in a first stage of heavy oil hydroprocessing. Crude petroleum from Kern County, California was hydroprocessed in a single stage reactor operated at 440° C., a 1 hour$^{-1}$ hourly space velocity, 160 atmospheres pressure and 1780 liters of hydrogen per liter of feed. Three feeds were employed. Feed A was Kern crude containing 250 ppm ammonium molybdate added as an aqueous emulsion. Feed B contained 10 weight percent spent fluid catalytic cracking catalyst fines which contained small amounts of nickel and vanadium contaminants. Feed C contained 10 weight percent of the fluid catalytic cracking catalyst fines as in Feed B, plus 250 ppm ammonium molybdate as in Feed A. The results are depicted in Table 2.

TABLE 2

| | Feed Kern Crude | A | B | C |
|---|---|---|---|---|
| Gravity, °API | 13.5 | 17.4 | 18.7 | 19.0 |
| TGA, wt. % | | | | |
| 343° C. | 12.4 | 41.2 | 62.2 | 47.8 |
| 343–537° C. | 44.6 | 43.4 | 29.3 | 42.0 |
| 537° C.+ | 43.0 | 15.5 | 8.5 | 10.2 |
| Atomic H/C ratio | 1.55 | 1.55 | 1.55 | 1.56 |
| N, wt. % | 0.74 | 0.76 | 0.74 | 0.71 |
| O, wt. % | 1.55 | 0.38 | 0.35 | 0.28 |
| S, wt. % | 1.22 | 0.62 | 0.65 | 0.57 |
| n-heptane insolubles, wt. % | 2.13 | 2.99 | 2.88 | 1.64 |
| Ni/V/Fe, ppmw | 64/33/18 | 59/26/4 | 41/16/5 | 17/7/<3 |
| $C_1$–$C_3$ Gas Make, wt. % MAF | — | 2.7 | 3.9 | 2.9 |

It is seen that when both the ammonium molybdate catalyst and the FCC fines were employed, the asphaltenes in the product were reduced significantly from the cases where FCC fines or ammonium molybdate were individually present. Likewise, the nickel, vanadium and iron concentrations were significantly decreased when both the dispersed catalyst and the FCC fines were present. The reduction in metal contamination in the first stage protects the second-stage catalyst from metals contamination.

It is contemplated that this invention can be practiced in a number of embodiments different from those disclosed without departing from the spirit and scope of the invention. Such embodiments are contemplated as equivalents to those described and claimed herein.

We claim:

1. A process for hydroprocessing a heavy hydrocarbonaceous oil feed to convert at least a portion of feed components boiling above 350° C. to components boiling below 350° C. comprising:

(a) contacting said oil with added hydrogen in a first reaction zone under hydroprocessing conditions, including a hydrogen partial pressure of above 35 atmospheres in the presence of (1) added dispersed hydrogenation catalyst suspended in said oil and containing at least one catalytic hydrogenation component selected from transition metal elements or compounds thereof, and (2) added porous contact particles to produce a first effluent having a normally liquid portion; and (b) contacting at least a portion of the normally liquid portion of said first effluent in a second reaction zone with hydrogen under hydrogenation conditions in the presence of a bed of particulate hydrogenation catalyst, to produce a second effluent.

2. A process according to claim 1 wherein said heavy hydrocarbonaceous oil contains soluble metal contaminants and at least 0.1 weight percent n-heptane insoluble asphaltenes, and said hydroprocessing conditions in said first reaction zone causing deposition of metals from said soluble metal contaminants onto said porous contact particles to produce a first effluent having a normally liquid portion with reduced soluble metals concentration.

3. A process according to claim 1 wherein said porous contact particles are substantially non-carbonaceous.

4. A process according to claim 1 wherein said added hydrogenation catalyst is present in said first reaction zone in an amount sufficient to substantially suppress coke accumulation within said first hydroprocessing zone.

5. A process according to claim 1, 2, 3, or 4 wherein said hydroprocessing conditions in said first reaction zone include a temperature in the range of 400° to 480° C., a pressure in the range of 40 to 680 atmospheres, a residence time of 0.1 to 3 hours and a hydrogen gas rate of 355 to 3550 liters per liter of feed, and said hydroprocessing conditions in said second reaction zone include a temperature lower than the temperature of said first reaction zone and in the range of 315° to 455° C., a pressure in the range of 40 to 340 atmospheres, a space velocity in the range of 0.1 to 2 $hour^{-1}$, and a hydrogen feed rate of 170 to 3400 liters per liter of feed.

6. A process according to claim 1, 2, 3, or 4 wherein said porous contact particles comprise material selected from the group of spent FCC catalyst fines, alumina, and naturally occurring clays.

7. A process according to claim 1, 2, 3, or 4 wherein said porous contact particles in said first reaction zone are suspended in said oil.

8. A process according to claim 1, 2, 3, or 4 wherein said porous contact particles in said first reaction zone are present in a packed bed.

9. A process according to claim 1, 2, 3, or 4 wherein said porous contact particles in said first reaction zone are present in a ebullating bed.

10. A process according to claim 1, 2, 3, or 4 wherein substantially all of the dispersed catalyst from said first reaction zone is passed to said second reaction zone.

11. A process according to claim 10 wherein said porous contact particles in said first reaction zone are suspended in said oil and substantially all of said porous contact particles are passed from said first reaction zone to said second reaction zone.

12. A process according to claim 1, 2, 3, or 4 wherein said particulate hydrogenation catalyst in said second reaction zone is present as a packed bed.

13. A process according to claim 10 wherein said particulate hydrogenation catalyst in said second reaction zone is present as a packed bed.

14. A process according to claim 12 wherein the entire liquid feed to said second reaction zone passes upwardly through said packed bed of particulate hydrogenation catalyst.

15. A process according to claim 10 wherein the effluent from the first reaction zone is substantially free of said contact particles and the entire liquid effluent from the first reaction zone is passed to said second zone.

16. A process according to claim 15 wherein said particulate hydrogenation catalyst in said second reaction zone is present as a packed bed and the entire liquid feed to said second reaction zone passes upwardly through said bed of particulate hydrogenation catalyst.

* * * * *